US007510490B2

(12) United States Patent
Bird

(10) Patent No.: US 7,510,490 B2
(45) Date of Patent: Mar. 31, 2009

(54) METHOD FOR DETERMINING LENGTH OF THE SHAFT OF AN INDIVIDUALLY ADAPTED GOLF CLUB

(76) Inventor: Darran Bird, Hanfstr 12, 66954 Pirmasens (DE) 66954

( * ) Notice: Subject to any disclaimer, the term of this patent is extended or adjusted under 35 U.S.C. 154(b) by 14 days.

(21) Appl. No.: 11/423,679

(22) Filed: Jun. 12, 2006

(65) Prior Publication Data

US 2006/0293117 A1 Dec. 28, 2006

(30) Foreign Application Priority Data

Jun. 14, 2005 (DE) ..... 10 2005 027 388

(51) Int. Cl.
*A63B 53/10* (2006.01)
*A63B 53/12* (2006.01)

(52) U.S. Cl. ..... 473/409

(58) Field of Classification Search ..... 473/409
See application file for complete search history.

(56) References Cited

U.S. PATENT DOCUMENTS

2003/0119597 A1* 6/2003 Wolter et al. ..... 473/314
2004/0172843 A1* 9/2004 Sones ..... 33/508
2005/0070369 A1* 3/2005 Wohldorf ..... 473/257

* cited by examiner

*Primary Examiner*—Stephen L. Blau
(74) *Attorney, Agent, or Firm*—R. Bernhardt

(57) ABSTRACT

The invention concerns a method for determining the length of the shaft of an individually adapted golf club. In accordance with the invention the lengths (11 to 15) of body parts of a golf player, which are decisive for the height position of his hands above the floor in the address position and during the swing, are measured and the length of the shaft is calculated from the measured lengths and predetermined angles (A, B, C, D) between the body parts as well as a pre-determined angle (E) between the arms and the shaft.

4 Claims, 1 Drawing Sheet

METHOD FOR DETERMINING LENGTH OF THE SHAFT OF AN INDIVIDUALLY ADAPTED GOLF CLUB

DESCRIPTION

Figure 1:
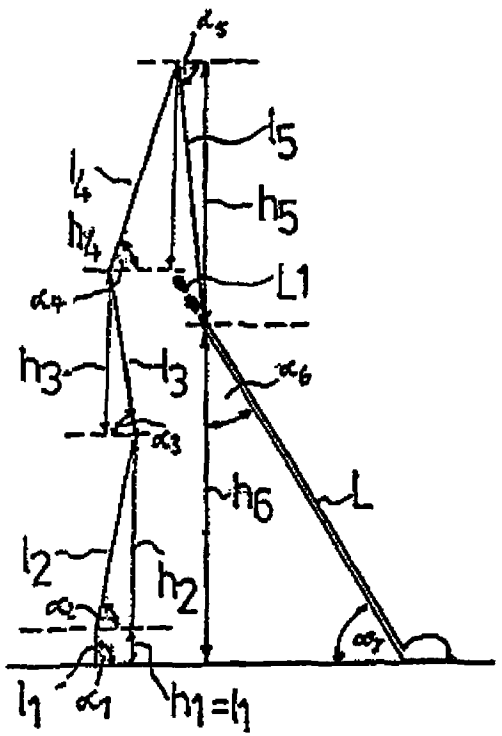

The invention concerns a method for determining the length of the shaft of an individually adapted golf club.

In conventional methods for determining the length of the shaft of an individually adapted golf club the height of the golfer and the distance between the ground and the wrist or fingertips of a golfer in a standing upright position is measured. Then, the length of the shaft is taken from a table including measurement values and corresponding length values.

It is the task of the invention to create a new procedure to determine the length of the shaft of an individually adapted golf club, which allows a more precise definition of the length of the shaft than the known methods.

The method according to the invention is characterized in that the lengths of body parts of a golfer, which are decisive for the height position of his hands above the floor in the address position and during the golf swing, are measured and the length of the shaft is calculated from the measured lengths and predetermined angles (A, B, C, D) between the body parts as well as a predetermined angle (E) between the arms and the shaft or a predetermined lie angle ($\alpha_7$).

That means, the method according to the invention is based on trigonometry. The lengths of the body parts of a golf player which are influential for the height position of the hands above the floor in the address position and during the swing are measured. Pre-determined angles between the body parts as well as a pre-determined angle between the arms and the shaft allow to calculate the length of the shaft. This process also allows a precise calculation of the lie angle.

In distinction from the prior art a more accurate calculation of shaft length is possible. It is also possible that the angles between the measured body parts can be chosen by the experience of the golf trainer, allowing a higher level of individuality.

The following measurements are taken, the length from the floor to the ankle joint (while wearing shoes of similar heel size to that of a golf shoe), the length from the ankle joint to the knee joint, the length from the knee joint to the hip joint, the length from the hip joint of the shoulder joint and the length from the shoulder joint to the knuckle of the middle finger of the right hand.

As the golfer adopts his address position (starting position) the player bends the spine forwards and a curvature of the spine will occur, shortening the distance between the hip and shoulder joints. If the measurements of the golfer are taken in a standing upright position, to accommodate for the curvature of the spine and the distance between the hip and shoulder joints, the taken measurement will be multiplied by 0.92 (or a similar factor).

The total length of the golf club is calculated from the above described process plus a second part of the shaft or end piece. The end shaft piece can be calculated from a characteristic hand measurement of the golfer with a given multiplication factor. Characteristic hand measurements would be the distance from the wrist joint to the tip of the middle finger. The multiplication factor is 0.73 or similar. Or with the thumb stretched away from the palm the distance from the end of the thumb or root of the thumb nail across the palm to the opposite side of the palm. In this case, the multiplication factor is one.

To make practical use of the measuring system a computer software can be used to either calculate mathematically the golf club length or the club length can be taken from a saved data base of golfers of all sizes and proportions.

In the following, referring to the enclosed drawings, the invention is further explained.

Figure 2:
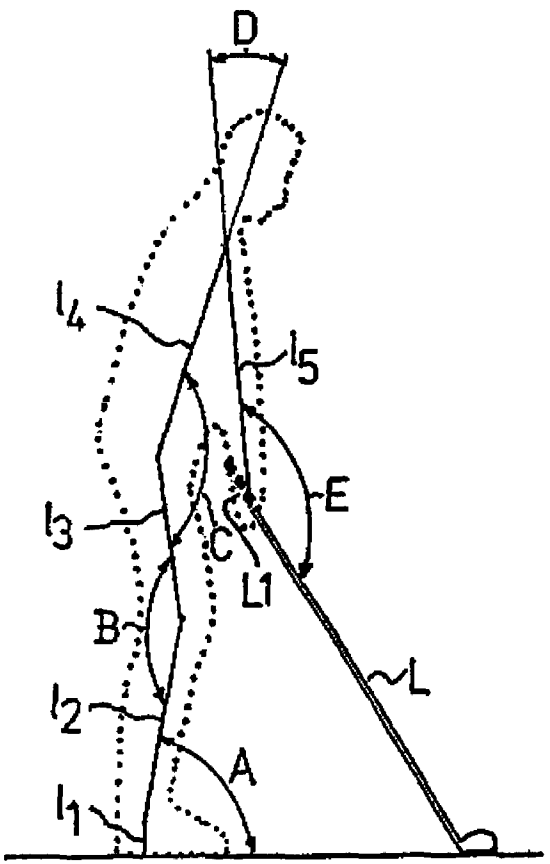

FIG. 1 shows the lengths (11 to 15) of body parts measured in the method according to the invention and, FIG. 2 shows a picture explaining the calculation of the length of the shaft of a golf club from the lengths (11 to 15).

To find out the length L of the shaft of a golf club the total length of which is L plus the length L1 of an end piece the following measurements are taken; the length 11 from the floor to the ankle, the length 12 from the ankle to the knee, the length 13 from the knee to the hip, the length 14 from the hip to the shoulder and the length 15 from the shoulder to the root of the middle finger of the right hand.

For the calculation of the golf club length pre-determined angles A, B, C, D between the above mentioned body parts are used. The angle E between the arms and golf club shaft is also included.

The height position h6 of the hand above the floor results from h6=h1+h2+h3+h4−h5. The heights hn (n=1 to 5) result from the multiplication of the respective length in with the sinus of the angle $\alpha$n between the horizontal and the length 1n: hn=Ln sin$\alpha$. The angles $\alpha$n can be calculated successively starting at angle A, by using the predetermined angles A, B, C, D and E by means of the fact that the sum of angles in a triangle is always 180°. As well as the angle $\alpha$6 between the vertical and the golf shaft. The angle $\alpha$1 is 90°.

The length L of the club required up to the player's hand results from L=(h6/cosinus $\alpha$6).

The length L can also be calculated from a predetermine lie angle $\alpha$7 and the height h6: L=h6/sinus $\alpha$7.

Alternatively, 15 an be measured from the shoulder to the middle of the edge of the left hand palm and the angle $E^7$ between the arm and the shaft, which differs from angle E, can be used.

The invention claimed is:

1. Method for determining the length of the shaft of an individually adapted golf club, wherein the length (11) form the floor to the ankle, the length (12) from the ankle to the knee, the length (13) from the knee to the hip, the length (14) from the hip to the shoulder and the length (15) from the shoulder to the root of the middle finger of the right arm, which lengths are decisive for the height position of a golfers hands above the floor in the address position and during golf swing, are measured and the length (L) of a first shaft piece up to a second shaft piece or end piece (L1) is calculated by the measured lengths and predetermined angles (A,B,C,D) between adjacent body parts corresponding to said lengths (11-15), as well as a predetermined angle (E) between the arms and the shaft or a predetermined lie angle ($\alpha$7) and wherein the respective lengths are measured while the golfer is standing upright, and the length measurement from the hip to the shoulder (14) is multiplied with a given correction factor to compensate for the curvature of the spine when the address position is taken.

2. Method of claim 1, wherein the total length (L+L1) of the golf club is obtained from the aforementioned length (L) calculated from the respective lengths and angles and the second shaft piece or end piece (L1), wherein the length of the shaft and piece (L1) is calculated from a measurement from the golfer's hand which is then multiplied with a predetermined factor.

3. Method of claim 2, wherein to calculate the length of the shaft end piece (L1) either the length of the hand from the wrist joint to the tip of the middle finger or with the thumb stretched away from the palm the distance from the end of the thumb or root of the thumb nail across the palm to the opposite side of the palm is measured in a direction at approximately 90° to the direction of that of the fingers.

4. Method of claim 1, wherein the golf club length is mathematically calculated using a computer software program, or is obtained from a previously saved data bank or table.

* * * * *